US011136208B2

(12) United States Patent
Ikeda

(10) Patent No.: US 11,136,208 B2
(45) **Date of Patent: *Oct. 5, 2021**

(54) SHEET SUPPLYING APPARATUS, IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Wataru Ikeda, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/704,787

(22) Filed: Dec. 5, 2019

(65) Prior Publication Data

US 2020/0115175 A1 Apr. 16, 2020

Related U.S. Application Data

(63) Continuation of application No. 16/234,493, filed on Dec. 27, 2018, now Pat. No. 10,654,669, which is a continuation of application No. 15/883,015, filed on Jan. 29, 2018, now abandoned, which is a continuation of application No. 15/260,091, filed on Sep. 8, 2016, now Pat. No. 9,878,861.

(51) Int. Cl.

| | |
|---|---|
| ***B65H 1/04*** | (2006.01) |
| ***B65H 1/14*** | (2006.01) |
| *B65H 1/26* | (2006.01) |

(52) U.S. Cl.

CPC ..... *B65H 1/14* (2013.01); *B65H 1/04* (2013.01); *B65H 1/266* (2013.01); *B65H 2403/511* (2013.01); *B65H 2403/544* (2013.01); *B65H 2403/61* (2013.01); *B65H 2405/15* (2013.01); *B65H 2801/06* (2013.01)

(58) Field of Classification Search

CPC ..... B65H 1/14; B65H 1/266; B65H 2403/61; B65H 2403/511; B65H 2403/544; B65H 2405/15

See application file for complete search history.

(56) References Cited

U.S. PATENT DOCUMENTS

| | | | | |
|---|---|---|---|---|
| 3,388,907 A * | 6/1968 | Snellman | B65H 31/34 | 271/222 |
| 3,937,095 A * | 2/1976 | Clymer | B65D 83/0005 | 312/319.7 |
| 5,257,778 A * | 11/1993 | Coombs | B65H 39/11 | 271/293 |
| 5,305,996 A | 4/1994 | Taniwa et al. | | |

(Continued)

*Primary Examiner* — Howard J Sanders
(74) *Attorney, Agent, or Firm* — Kim & Stewart LLP

(57) ABSTRACT

It is an object of the present invention to provide method for receiving sheets for a sheet supplying apparatus. The method includes converting an up and down motion of a tray to a rotational motion of a rotary member by a movement conversion mechanism, converting the rotational motion of the rotary member around a rotational axis to a linear motion of a cylindrical member parallel to the rotational axis by the rotary member and a cam and slider mechanism, and elastically pressing an end portion of the cylindrical member of the cam and slider mechanism in the rotational axis direction to lift the tray by a compression spring.

20 Claims, 12 Drawing Sheets

(56) References Cited

U.S. PATENT DOCUMENTS

| | | | |
|---|---|---|---|
| 5,882,005 | A | 3/1999 | Araseki et al. |
| 6,568,675 | B1 | 5/2003 | Boss |
| 7,686,293 | B2 | 3/2010 | Baena, Jr. et al. |
| 7,997,574 | B2 | 8/2011 | Sugiyama |

* cited by examiner

SHEET SUPPLYING APPARATUS, IMAGE FORMING APPARATUS

CROSS-REFERENCE TO RELATED APPLICATION

This application is a continuation of U.S. patent application Ser. No. 16/234,493, filed on Dec. 27, 2018, which is a continuation of U.S. patent application Ser. No. 15/883,015, filed on Jan. 29, 2018, which is a continuation of U.S. patent application Ser. No. 15/260,091, filed on Sep. 8, 2016, now U.S. Pat. No. 9,878,861, issued on Jan. 30, 2018, the entire contents of which are incorporated herein by reference.

TECHNICAL FIELD

This specification relates generally to the structure of a sheet supplying apparatus.

BACKGROUND

There is proposed a sheet supplying apparatus externally attached to an image forming apparatus such as an MFP (Multi Function Peripheral). This sheet supplying apparatus is attached to the exterior of one side of the image forming apparatus. Several thousand sheets for printing are stacked on a tray provided for stacking the sheets. Therefore, the sheet supplying apparatus is also called LCF (LARGE-CAPACITY-FEEDER). The tray moves up as the number of stacked sheets decreases by a lift mechanism in the sheet supplying apparatus to keep the top position of the sheets stacked on the tray at certain height. The sheets stacked on the tray are picked up by a pickup roller one by one in order from the sheet at the top position, delivered to a separating and conveying roller pair configured to, for example, prevent double feeding of sheets, and fed to a sheet conveying system in the MFP.

In the sheet supplying apparatus, a sheet stacking section in which a tray capable of moving up and down is provided in a housing-like exterior member which is configured to be drawn out therefrom in a drawer like fashion. When the sheet stacking section is drawn out the tray appears.

When a user refills the sheet stacking section with sheets, in order to supply sheets, a user draws out the sheet stacking section and sequentially stacks up the sheet bundles on the tray.

In the sheet supplying apparatus, a driven portion of the lift up mechanism is engaged with a driving source of the sheet supplying apparatus when the sheet stacking section is fully attached in the housing-like exterior member, i.e., not drawn out. On the other hand, the engagement between the driven portion and the driving source is released when the sheet stacking section is drawn out from the housing-like exterior member.

However, when the sheet stacking section is drawn out from the housing-like exterior member while a large number of sheets are stacked on the tray, the tray with the large number of sheets suddenly falls or drops because of the disengagement between the driven portion and the driving source.

It is possible to use, for example, a centrifugal brake or a helical torsion spring having high torsional torque to prevent a tray with a large number of sheets from a collision against an end of the tray guide member (shock absorption).

However, the centrifugal brake and the helical torsion spring having high torsional torque are generally expensive.

SUMMARY

According to an aspect of the present invention, there is provided a method for receiving sheets for a sheet supplying apparatus having a tray on which plural sheets are stackable, a guide mechanism configured to freely guide the tray in an up and down direction, a movement conversion mechanism configured to convert an up and down motion of the tray to a rotational motion, a rotary member rotatably supported around a predetermined rotational axis and comprising a transmitted portion configured to receive a rotational motion converted from the up and down motion of the tray in cooperation with the movement conversion mechanism and a driven portion configured to receive a rotational driving force from a driving source to lift the tray, a cam and slider mechanism having a protrusion which integrally rotates with the rotary member and a cylindrical member through which the rotary member is inserted, the cylindrical member having a spiral groove formed on an inner surface thereof, and configured to convert the rotational motion of the rotary member around the rotational axis to a linear motion of the cylindrical member parallel to the rotational axis, and a compression spring configured to elastically press an end portion of the cylindrical member of the cam and slider mechanism in the rotational axis direction to lift the tray. The method includes converting an up and down motion of the tray to a rotational motion of the rotary member by the movement conversion mechanism, converting the rotational motion of the rotary member around the rotational axis to a linear motion of the cylindrical member parallel to the rotational axis by the rotary member and the cam and slider mechanism, and elastically pressing an end portion of the cylindrical member of the cam and slider mechanism in the rotational axis direction to lift the tray by the compression spring.

DETAILED DESCRIPTION

An embodiment of the present invention is explained below with reference to the accompanying drawings.

In the embodiments herein, the tray is coupled to a drive in the sheet feeding apparatus, and when the drawer on which the tray is supported is withdrawn to replace the sheets on the tray, the coupling between the tray and the sheet feeding apparatus is decoupled, and the tray falls under its own weight and the weight of any sheets still remaining thereon. To reduce the shock otherwise caused by rapid falling of the tray 106, the drawer includes a shock absorbing mechanism. The shock absorbing mechanism includes a rod shaped rotary member 109 having at least one protrusion 109*e* extending radially therefrom, and a sleeve like cylindrical member 108 with an internal spiral pitch groove. The cylindrical member 108 is fixed against rotation, and the rotary member is supported at the ends thereof so that it can rotate around its rotational axis. The rotary member 109 extends through the cylindrical member 108, and rotation of the protrusion 109*e* by rotation of the rotary member 109 causes the cylindrical member 108 to move in the direction of the rotational axis of the rotary member. A coil spring 110 surrounds a portion of the rotary member 109, and is compressed by the axial motion of the cylindrical member 108. One end of a wire rope 111*w* is windable around one end of the rotary member, extends over a pulley, and is attached at the other end thereof to the tray 106. As the tray 106 falls, the rope unwinds from around the rotary member 109 and causes the cylindrical member 108 to slide axially and compress the spring 110, dampening the falling of the tray 106.

First Embodiment

An image forming apparatus according to a first embodiment of the present invention is explained below. First, an image processing system including a sheet supplying apparatus according to this embodiment is explained with reference to FIGS. 1 to 3.

Figure 1:
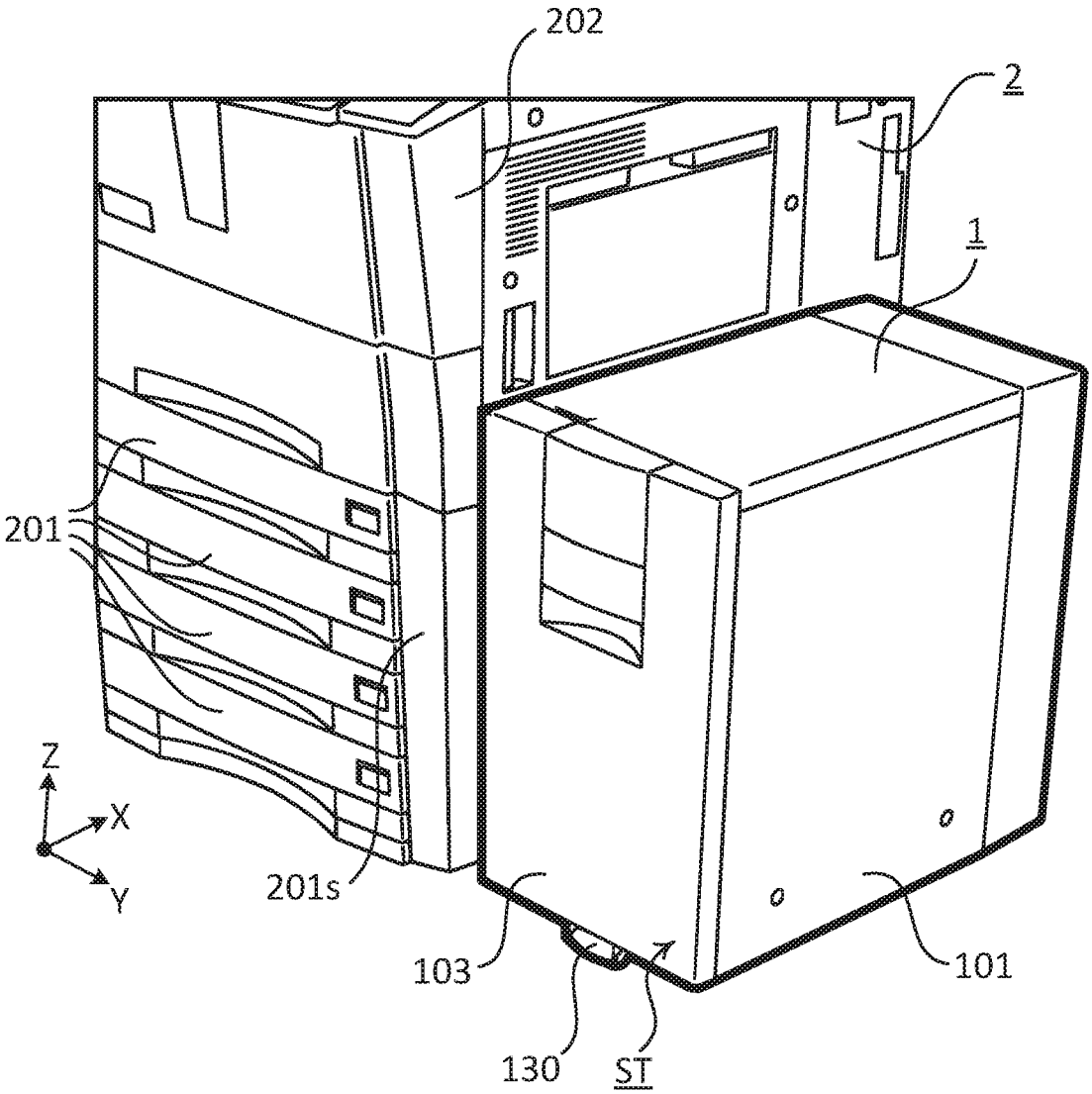
FIG. 1 is a schematic configuration view depicting an image processing system according to a first embodiment of the invention.
Figure 2:
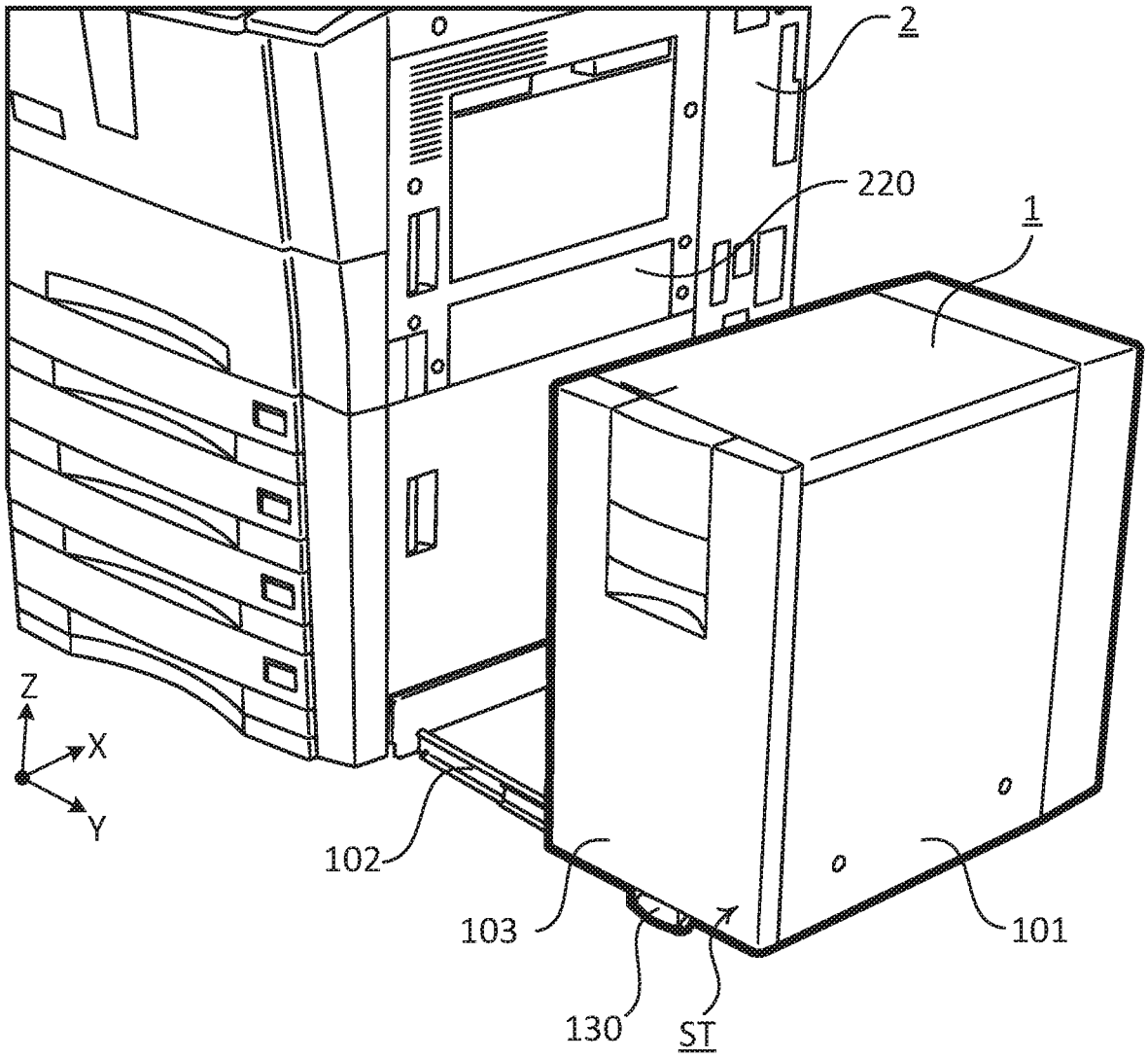
FIG. 2 is a schematic configuration view depicting an image processing system according to a first embodiment of the invention.
Figure 3:
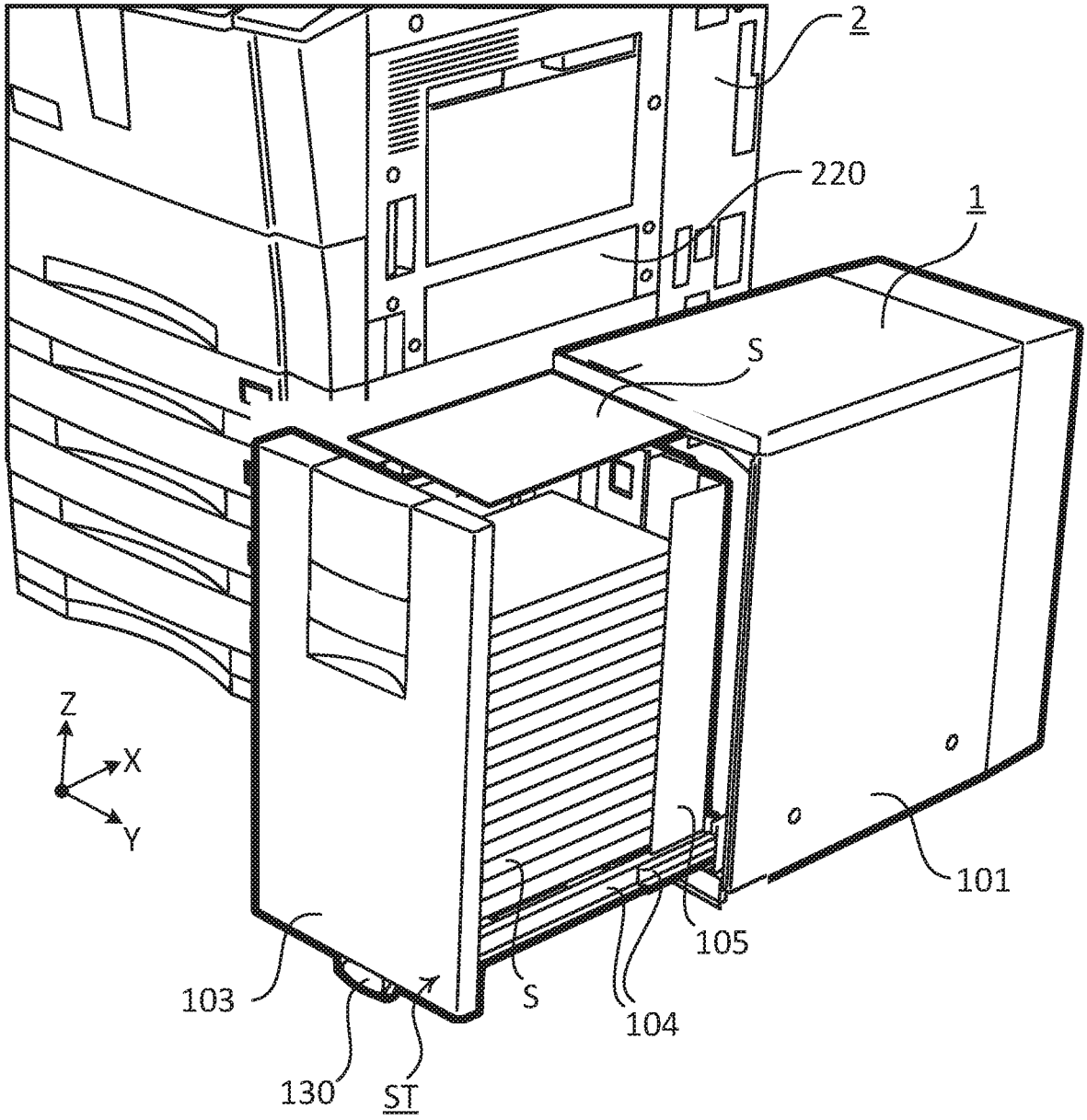
FIG. 3 is a schematic configuration view depicting an image processing system according to a first embodiment of the invention.

FIGS. 1 to 3 are schematic configuration views depicting an image processing system (MFP: multi-function peripheral) according to this embodiment of the invention.

As shown in FIG. 1, the image processing system according to this embodiment includes an image forming apparatus 2 and a sheet supplying apparatus 1.

The image forming apparatus 2 forms an image on a sheet on the basis of image data acquired by scanning an original or image data received via a network.

The sheet supplying apparatus 1 can supply a large number of sheets (for example, several thousand sheets) as recording media to the image forming apparatus 2.

In FIG. 1, an X axis, a Y axis, and a Z axis are axes orthogonal to one another. The Z axis is an axis corresponding to an up-to-down direction of the sheet supplying apparatus 1 and the image forming apparatus 2. A relation among the three axes X, Y, and Z is the same in the other figures.

In FIG. 1, in an image forming apparatus 2, which is an example of an image forming apparatus including a printer function and a copy function, paper feeding cassettes 201 configured to store sheets for printing are arranged in plural stages in a lower part. A printer section 202 is arranged on the paper feeding cassette section 201*s*. The sheets stored in the paper feeding cassettes 201 are fed to the printer section 202 (image forming unit) by a sheet conveyer 220 (FIGS. 2 and 3) in which a sheet conveying path extends in the up-down direction. The sheets having images printed thereon by the printer section 202 are discharged to a paper discharge tray at the upper end of the image forming apparatus 2. The sheet conveyer 220 is arranged on one side of the image forming apparatus 2.

As shown in FIG. 2, the sheet supplying apparatus 1 is slidably supported by slide guide 102 extending in a Y axis direction from the lower end of the image forming apparatus 2. The sheet supplying apparatus 1 performs paper feeding to the sheet conveyer 220 of the image forming apparatus 2 in a state in which the sheet supplying apparatus 1 is attached to the one side of the image forming apparatus 2 (FIG. 1). The sheet conveyer 220 is also configured to convey a sheet supplied from the sheet supplying apparatus 1 along a predetermined conveying path to the printer section 202.

When a user refills the sheet supplying apparatus 1 with sheets, at first, the user pulls the sheet supplying apparatus 1 away from the image forming apparatus 2 in the Y axis direction as shown in FIG. 2. Then, the user draws out a sheet stacking section ST from a casing 101, which is supported by a slide guide 104, in the X axis direction (FIG. 3).

Figure 4:
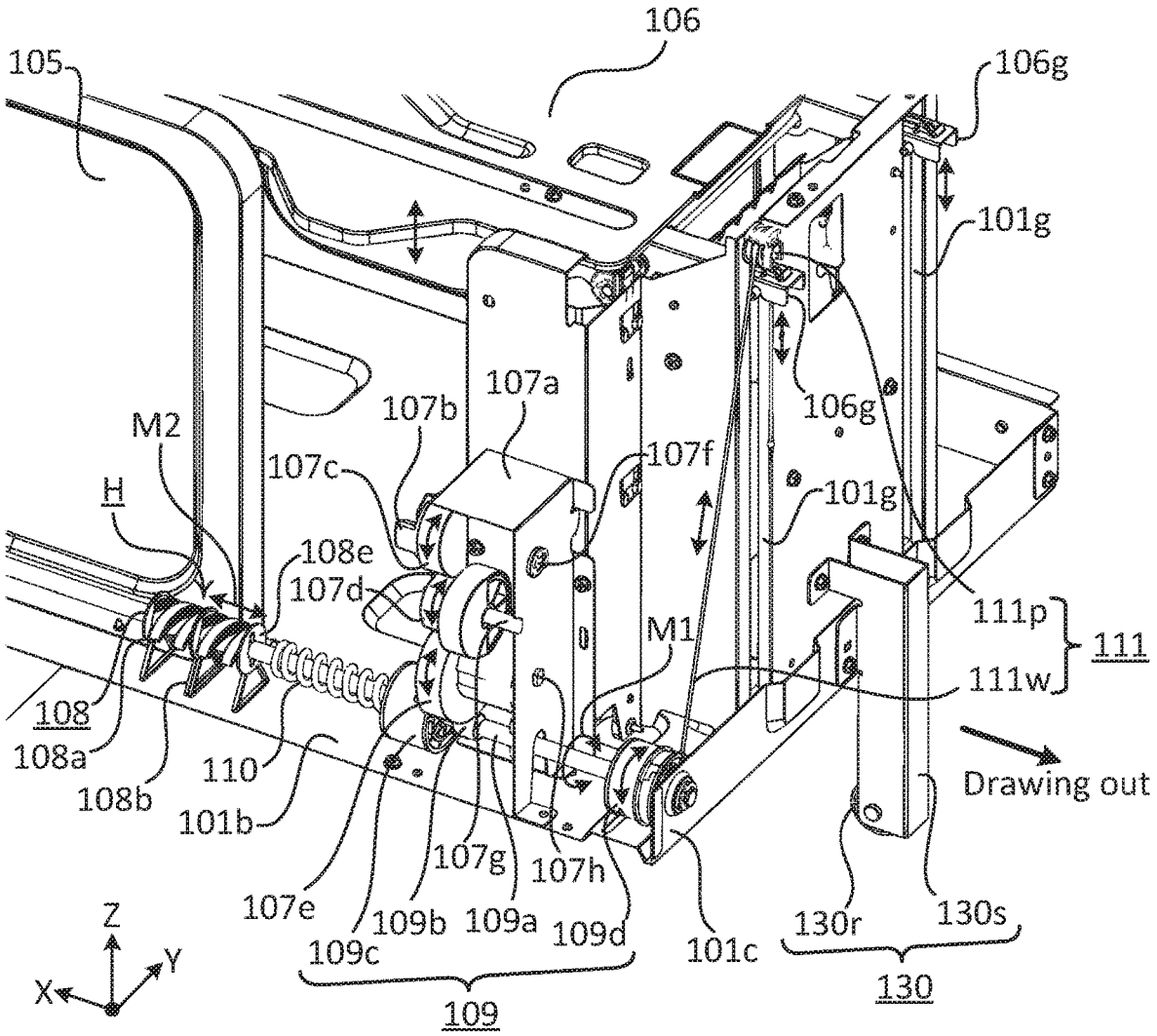
FIG. 4 is a partial schematic perspective view depicting an internal structure of the sheet supplying apparatus 1 in the first embodiment.

FIG. 4 is a partial schematic perspective view of the sheet supplying apparatus 1 of the first embodiment.

The sheet stacking section ST has, for example, a base plate 101*b*, a front cover 103 (shown in FIGS. 1 to 3), a side guide 105, a tray 106, a guide mechanism 101*g*, a movement conversion mechanism 111, a rotary member 109, a supporting portion 130, a cam and slider mechanism H and a compression spring 110.

The guide mechanism 101*g* guides the tray 106 so that the tray 106 can slide freely in an up and down direction (Z axis direction). The guide mechanism 101*g* is, for example, a linear motion guide. The user can stack plural sheets on the tray 106 guided by the guide mechanism 101*g*. In FIG. 4, the tray 106 is at a highest position (first height position).

The movement conversion mechanism 111 converts an up and down motion of the tray 106 in the Z axis direction to a rotational motion around the X axis direction. The movement conversion mechanism 111 includes a pulley 111*p* and a wire rope 111*w*. One end of the wire rope 111*w* is connected to an end portion of the tray 106 and the other end of the wire rope 111 is connected across the pulley 111*p* to a rotational cylindrical body 109*d*.

The rotary member 109 is a longitudinal member supported rotatably around a predetermined rotational axis which is parallel with X axis. The rotary member 109 is supported rotatably at one end thereof by aside wall 101*c* extending from one end of the base plate 101*b*, and at the other end by a side wall (not shown) extending from an opposite end of the base plate 101*b*.

The rotary member 109 includes the rotational cylindrical body (transmitted portion) 109*d* at one end thereof in the rotational axis direction. The transmitted portion 109*d* converts the up and down motion of the tray 106 into rotation of the rotary member, by winding and unwinding the wire rope 111*w* thereabout in cooperation with the movement conversion mechanism 111. With this structure, the tray 106 will move upwardly as the rotational cylindrical body 109*d* rotates and thereby winds up the wire rope 111*w* thereon.

The rotary member 109 also includes a driven portion 109*b* configured to receive a rotational driving force to lift up the tray 106 from a driving source (not shown) of the sheet supplying apparatus 1 through a coupler 107*b* and gears 107*c*, 107*d* and 107*e* in a gear train, when the sheet stacking section ST is fully inserted into the casing 101. Each of the coupler 107*b* and the gears 107*c*, 107*d* and 107*e* is rotatably supported by a shaft 107*f*, 107*g* and 107*h* fixed to a casing 107*a* which is fixed on the base plate 101*b*. In this embodiment, the driven portion 109*b* is, for example, a gear. The rotational driving force is transmitted from the gear 107*e* to the driven portion 109*b* as the gear. Here, a coupler of the driving source of the sheet supplying apparatus 1 engages with the coupler 107*b* when the sheet stacking section ST is fully inserted into the casing 101. However, it is possible to apply other force transmission mechanisms such as a belt drive transmission system and a chain drive transmission system to transmit the driving force from the driving source to the driven portion 109*b*.

The cam and slider mechanism H converts rotational motion M1 of the rotary member 109 around the rotational axis into linear motion M2 of a cylindrical member (linearly movable member) 108 parallel to the rotational axis.

Figure 5:
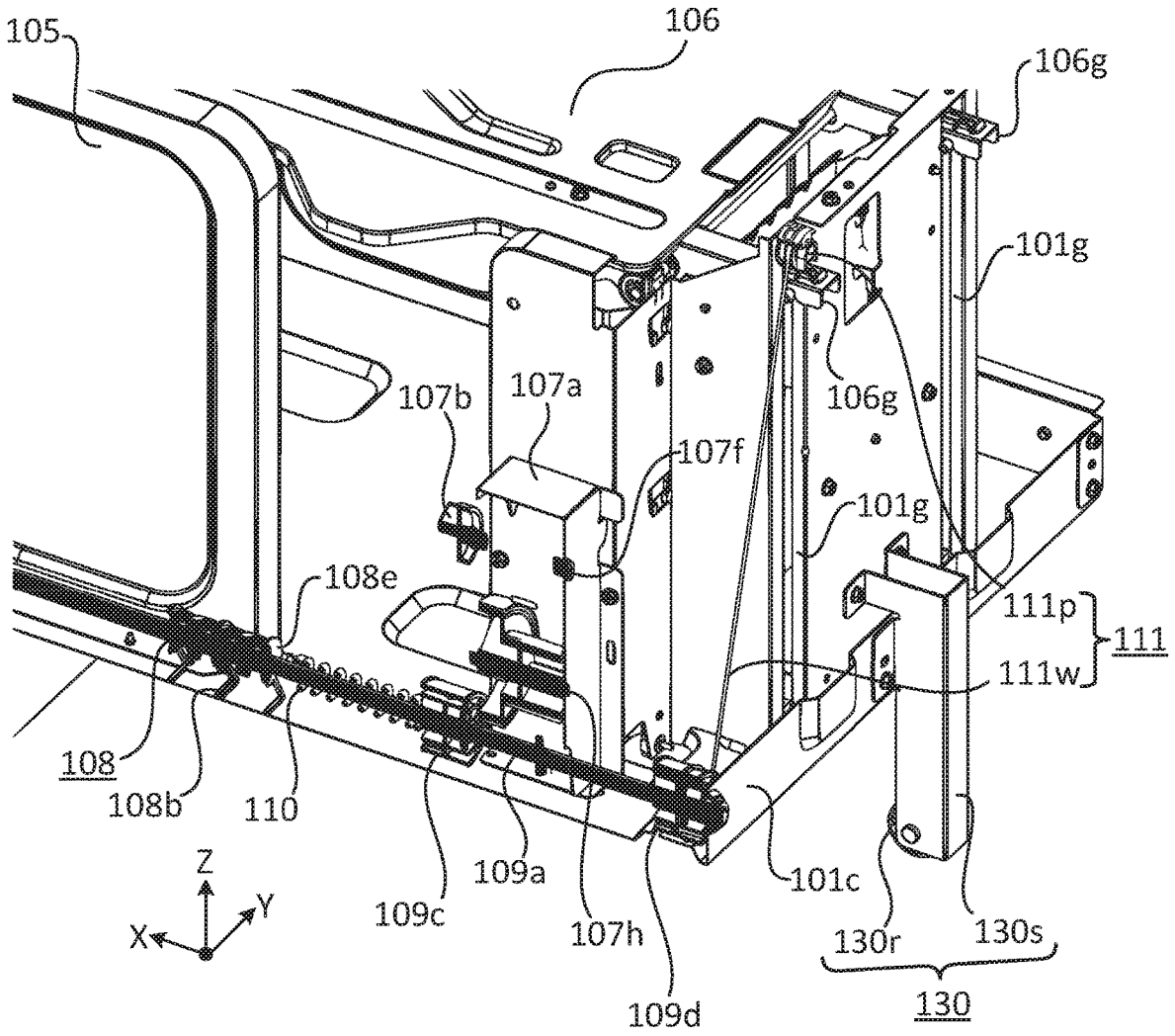
FIG. 5 is a partial sectional view in an X-Z plane including the rotational axis of the rotary member 109 depicting the cam and slider mechanism H in the first embodiment.
Figure 6:
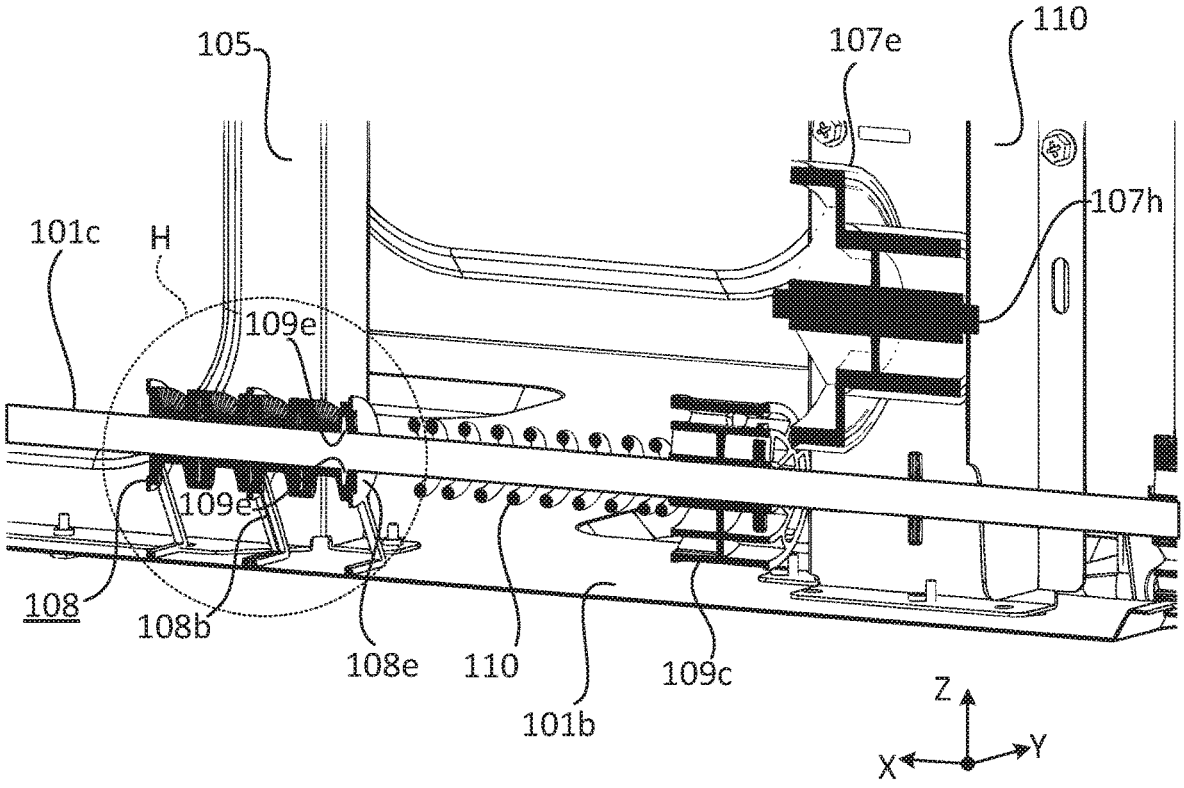
FIG. 6 is an enlarged partial sectional view in an X-Z plane including the rotational axis of the rotary member 109 depicting the cam and slider mechanism H in the first embodiment.

FIGS. 5 and 6 are partial sectional views in an X-Z plane including the rotational axis of the rotary member 109 seen from a direction parallel to the Y axis showing a basic structure of the cam and slider mechanism H in the first embodiment.

The cam and slider mechanism H has a protrusion 109*e* of the rotary member 109 and a cylindrical member 108 (FIG. 6). The protrusion 109*e* integrally rotates with the main body of the rotary member 109. The rotary member 109 is inserted through the cylindrical member 108.

Figure 7:
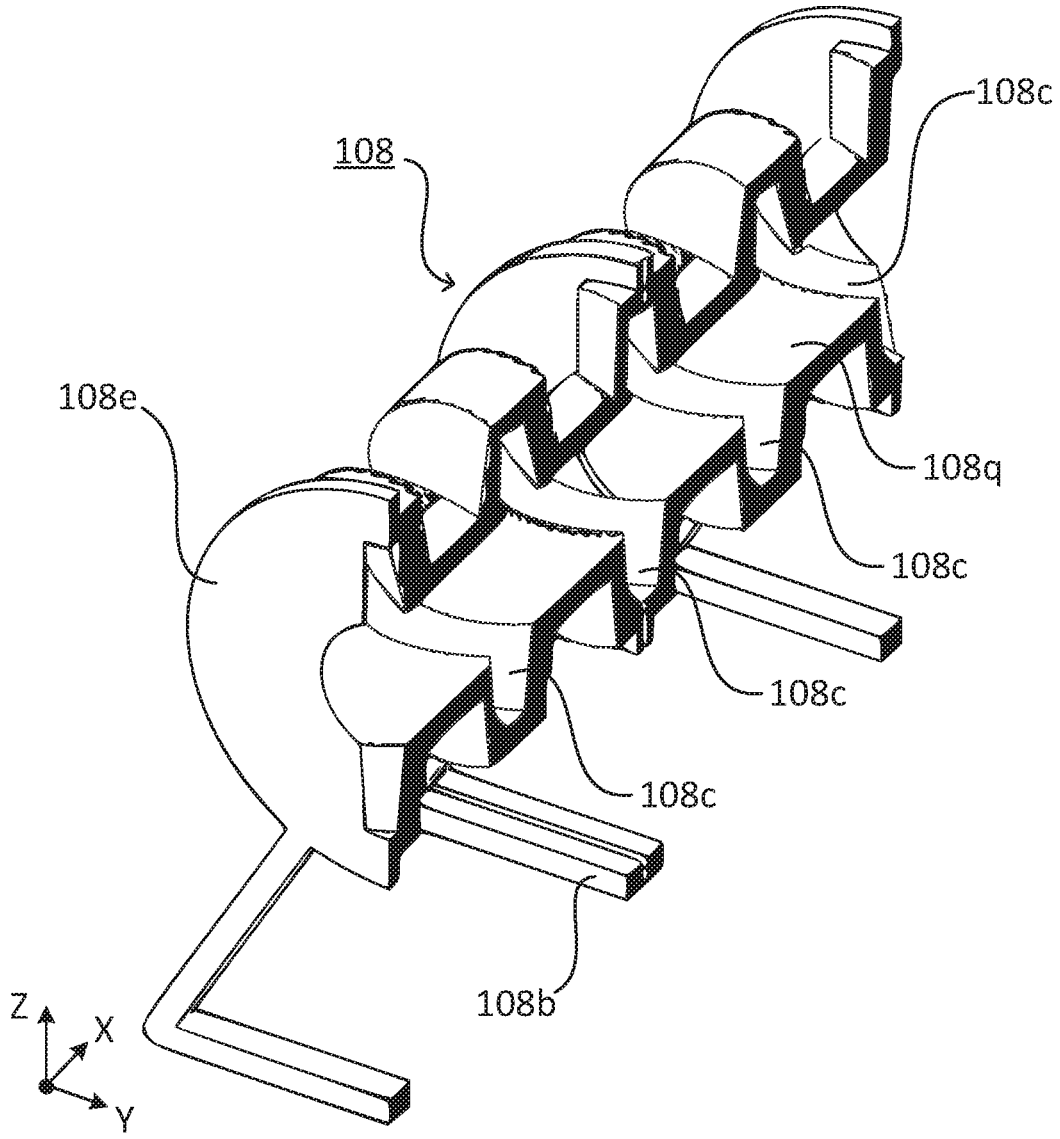
FIG. 7 is a sectional view in an X-Z plane depicting an inner structure of the cylindrical member 108 in the first embodiment.
Figure 8:
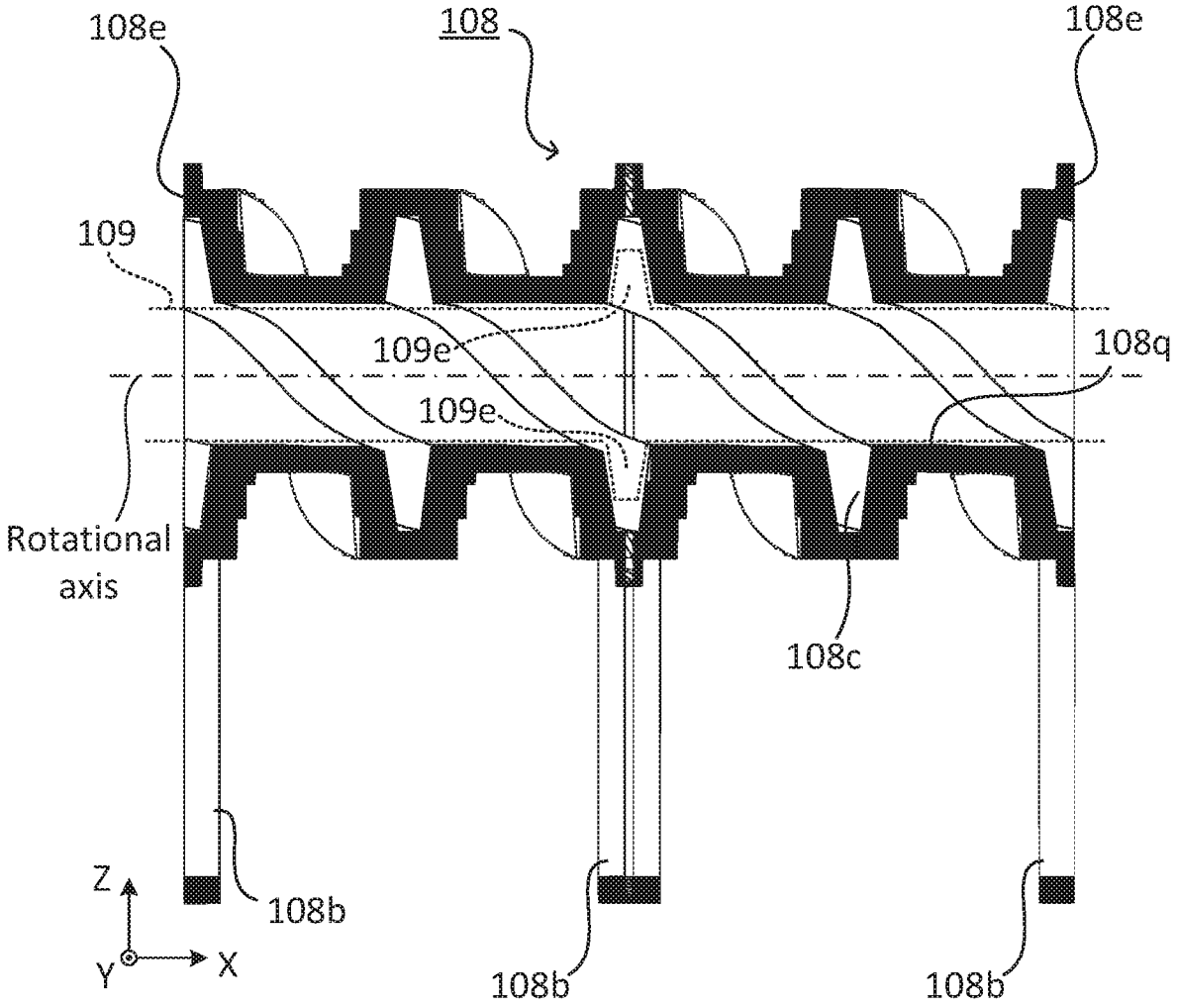
FIG. 8 is a sectional view in an X-Z plane depicting an inner structure of the cylindrical member 108 in the first embodiment.

FIGS. 7 and 8 are sectional views in an X-Z plane including the rotational axis of the rotary member 109 seen from a direction parallel to the Y axis showing an inner structure of the cylindrical member 108 in the first embodiment. In the embodiment, the cylindrical member 108 has two spiral grooves 108*c* of the same pitch located 180 degrees apart and extending inwardly of the inner surface thereof, into which two different protrusions 109*e* disposed 180 degrees apart on the rotary member 109 protrude.

The compression spring 110 elastically presses on an end portion 108*e* of the cylindrical member 108 of the cam and slider mechanism H in the rotational axis direction to apply a force to lift the tray 106, and compressed is by sliding movement of the cylindrical member 108 caused by engagement of the protrusions 109*e* with the grooves 108 *c* as the rotary member 109 is rotated as the wire rope 111*w* is pulled by the falling tray 106.

Specifically, the compression spring 110 is a coil spring. Here, a volute spring also can be applied as the compression spring 110 to receive a large load which is larger than the load normal coil spring can accommodate with good space efficiency.

The rotary member 109 is inserted through the compression spring 110 along a spiral center axis of the compression spring 110 (FIG. 6). The rotary member 109 also has a stopper 109*c* to engage against one end of the compression spring 110.

The rotary member 109 has a plurality of the protrusions 109*e* provided at different angular positions in a rotational direction of the rotary member 109 (FIG. 6) along the same spiral pitch of the grooves 108*c* of the cylindrical member 108. With this structure the cam and slider mechanism H stably transmits the rotational force of the rotary member 109 to the cylindrical member 108. The protrusions 109*e* are arranged at an equal angle around the rotational axis of the rotary member 109. In this embodiment, the rotary member 109 has two protrusions 109*e* at opposed angular positions, i.e., 180 degrees apart around the rotary member axis (FIGS. 6 and 8), and each fits into a different groove 108*c*. Also, it is possible to forma continuous protrusion such as a worm gear on an outer surface of the rotary member 109 along a rotational direction of the rotary member.

Figure 9:
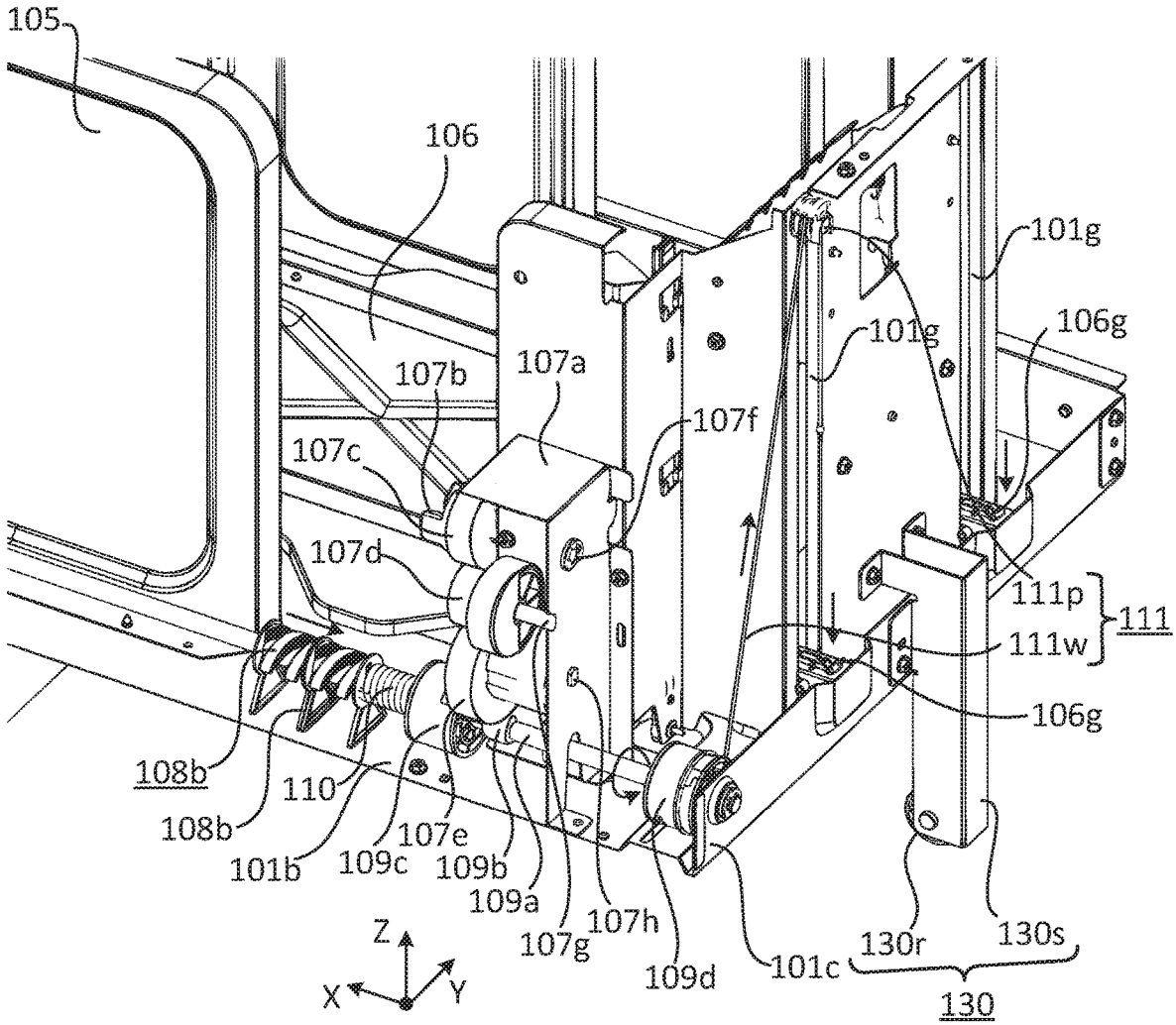
FIG. 9 is a partial schematic perspective view depicting the sheet supplying apparatus 1 when the tray 106 is at its lowest position.
Figure 10:
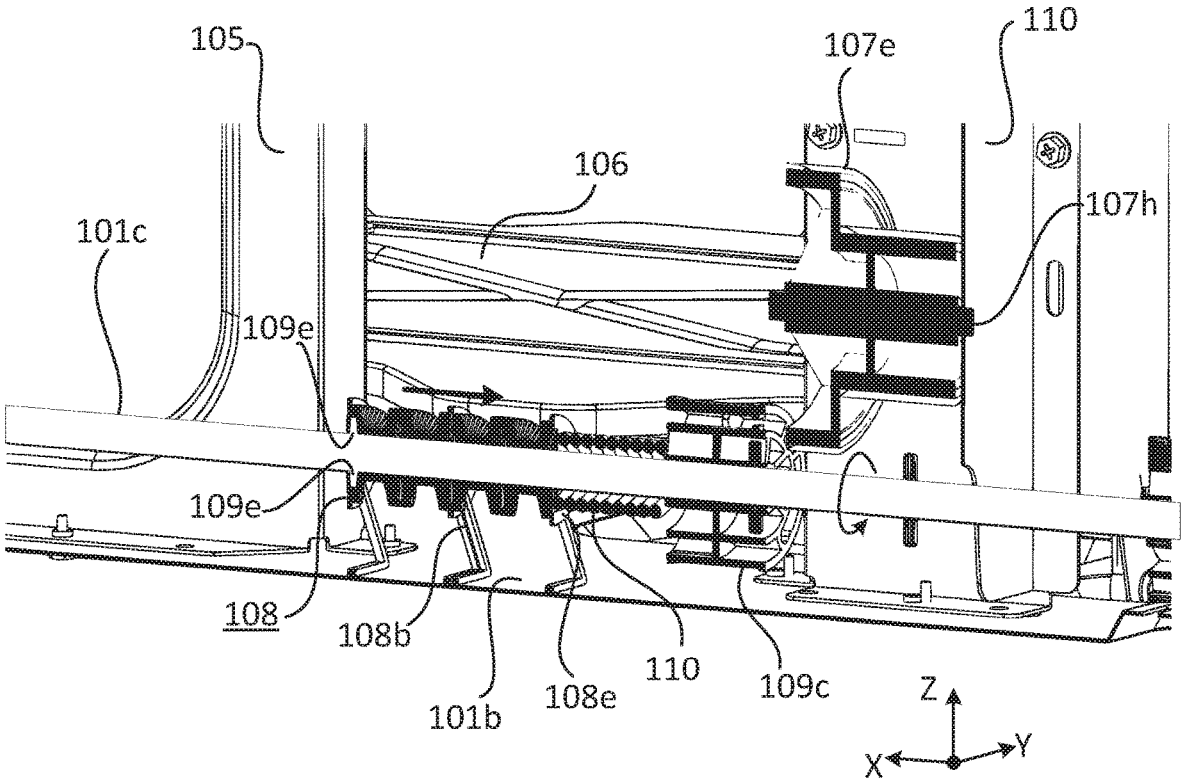
FIG. 10 is a partial sectional view in an X-Z plane showing a basic structure of the cam and slider mechanism H when the tray 106 is at a lowest position.

The cylindrical member 108 includes an anti-rotation bracket 108*b* secured thereto having a plurality of legs 108*b* which contact the inner surface of the base plate 101*b*. The anti-rotation bracket can slide on the inner surface of the base plate 101*b*, but the portion of the legs thereof which contact the inner surface of the base plate 101 extend in the Y direction whereas the cylindrical member 108 extends in the X direction, and thus the legs 108*b* prevent the rotation of the cylindrical member 108 around the rotational axis but allow movement thereof in the X direction. FIG. 9 is a partial schematic perspective view of the sheet supplying apparatus 1 when the tray 106 is at its lowest position (second height position). FIG. 10 is a partial sectional view in an X-Z plane including the rotational axis of the rotary member 109 seen from a direction parallel to the Y axis showing the cam and slider mechanism H when the tray 106 is at its lowest position.

When the sheet supplying apparatus 1 is in use with the image forming apparatus, the tray 106 is moved up by the driving force from the driving source of the sheet supplying apparatus 1 as the number of stacked sheets in the tray 106 decreases to keep the top position of the sheets stacked on the tray 106 at certain height.

The engagement between the coupler 107*b* (driven portion) and the driving source (not shown) is released when the sheet stacking section ST is drawn out from the casing 101. If the sheet stacking section ST is drawn out from the casing 101 while a large number of sheets are stacked on the tray 106, the tray with the large number of sheets will rapidly fall because the tray 106 is no longer supported in the Z direction as a result of the disengagement between the coupler 107*b* and the driving source as shown in FIGS. 9 and 10.

Even when the tray 106 with the large number of sheets falls as a result of the disengagement between the coupler 107*b* and the driving source, the compression spring 110 and the cam and slider mechanism H efficiently absorb the shock because of the weight of the tray 106 and the sheets stacked thereon by both of the elastic pressing force by the compression spring 110 as the compression spring is compressed and a frictional resistance of the cam and slider mechanism H, i.e., they dampen the speed at which the falling tray comes to rest at its lowest position. As shown in FIG. 4, with the tray 106 in the raised position, the spring 110 is in a free state, i.e., it is not compressed by the cylindrical member 108. As the tray 106 falls from the position thereof in FIG. 4 to that in FIGS. 9 and 10, the end of the wire rope 111*w* connected to the tray 106 moves in the downward direction. As the wire rope 111*w* is connected to the receiving member 109*c* across pulley 111*p*, this causes the wire rope 111*w* at the rotational cylindrical body 109*d* pull upwardly, causing the rotational cylindrical body 109*d* and the rotary member 109 connected thereto to rotate in a direction causing the cylindrical member to move the end of the spring 110 it contacts in the direction of the stopper 109*c*, thereby compressing the spring 110 and dampening the falling of the tray 106.

When the drawer is closed and coupler 107*b* is engaged with the driving source, the rotational force form the driving source can be transmitted to the driven portion 109*b* to rotate the rotary member 109 through the gears 107*c*, 107*d* and 107*e* in the gear train, and thereby lift the tray 106 with the wire rope 111*w* and rewind the wire rope 111*w* on the rotation cylindrical body 109*d*. With this structure, the tray 106 moves upwardly as the rotational cylindrical body 109*d* rotates and thereby winds up the wire rope 111*w* thereon and pull the tray 106 upwardly to keep the top position of the sheets stacked on the tray 106 at certain height. The sheets stacked on the tray are picked up by a pickup roller one by one in order from the sheet at the top position, and delivered to the sheet conveyer 220 in the image forming apparatus 2.

In this embodiment, the end of the compression spring 110 does not always need to touch the end portion 108*e* of the cylindrical member 108 and the end portion of the stopper 109*c*. Even when there is a clearance between the end portion of the compression spring 110 and either one of the end portions of the cylindrical member 108 or the stopper 109*c* in the state that the tray 106 is at the highest position, both end portions of the compression spring 110 will be engaged with both of the end portions of the cylindrical member 108 and the stopper 109*c* in the state that the tray 106 is at a certain height which is lower than the highest position.

Figure 11:
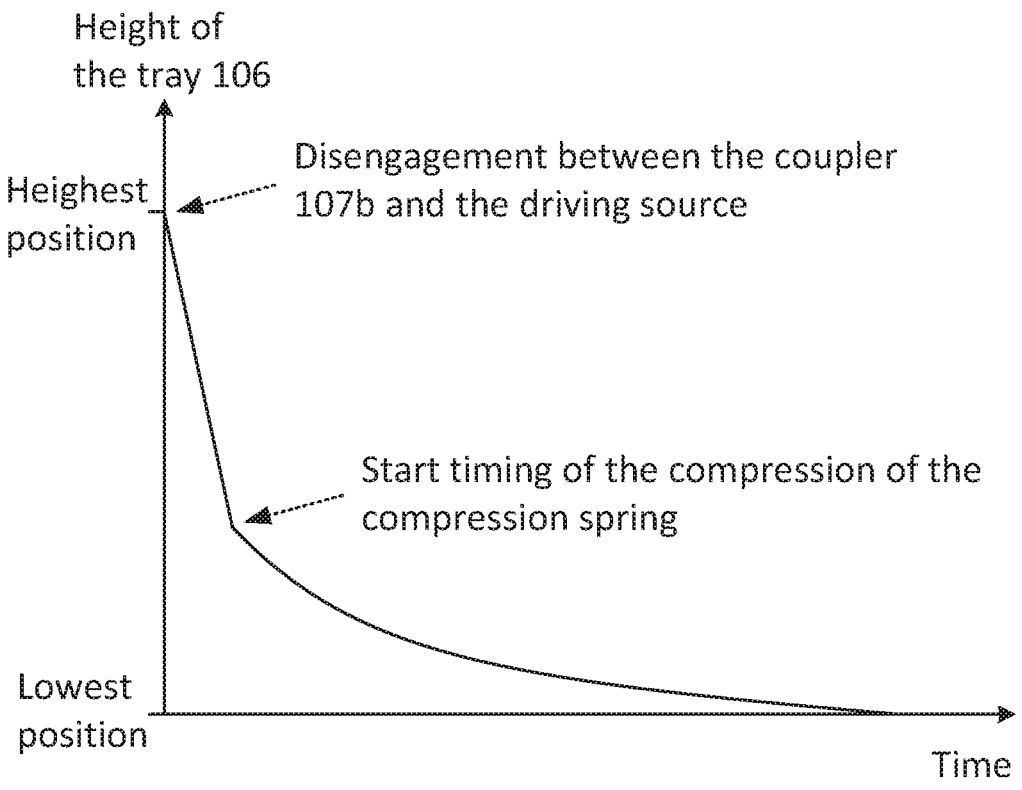
FIG. 11 is a graph showing the relation between the height of the tray and time just after the sheet stacking section is drawn out from the casing.

FIG. 11 is a graph showing the relation between the height of the tray 106 and time just after the sheet stacking section ST is drawn out from the casing 101. In FIG. 11, its vertical axis is for the height of the tray 106, and the horizontal for the time. As shown in FIG. 11, the tray 106 suddenly falls down from the timing of the disengagement between the coupler 107*b* and the driving source till start timing of the compression of the compression spring 110 since the weight of the tray 106 and the sheets stacked thereon are received only by the frictional resistance by the cam and slider mechanism H. On the other hand, after the compression of the compression spring 110 starts, a failing speed of the tray 106 gradually decreases by both of the elastic pressing force by the compression spring 110 and a frictional resistance of the cam and slider mechanism H. Here, the highest position and the lowest position in FIG. 11 are determined based on the amount of the sheets on the tray 106 and the weight of the tray 106 and the sheets stacked thereon.

Second Embodiment

An image forming apparatus according to a second embodiment of the present invention is explained below.

The second embodiment is a modification of the first embodiment. In the following explanation, in this embodiment, components having functions same as those explained in the first embodiment are denoted by the same reference numerals and signs and explanation of the components is omitted. Only point of the second embodiment different from the first embodiment is a structure of the cylindrical member.

Figure 12:
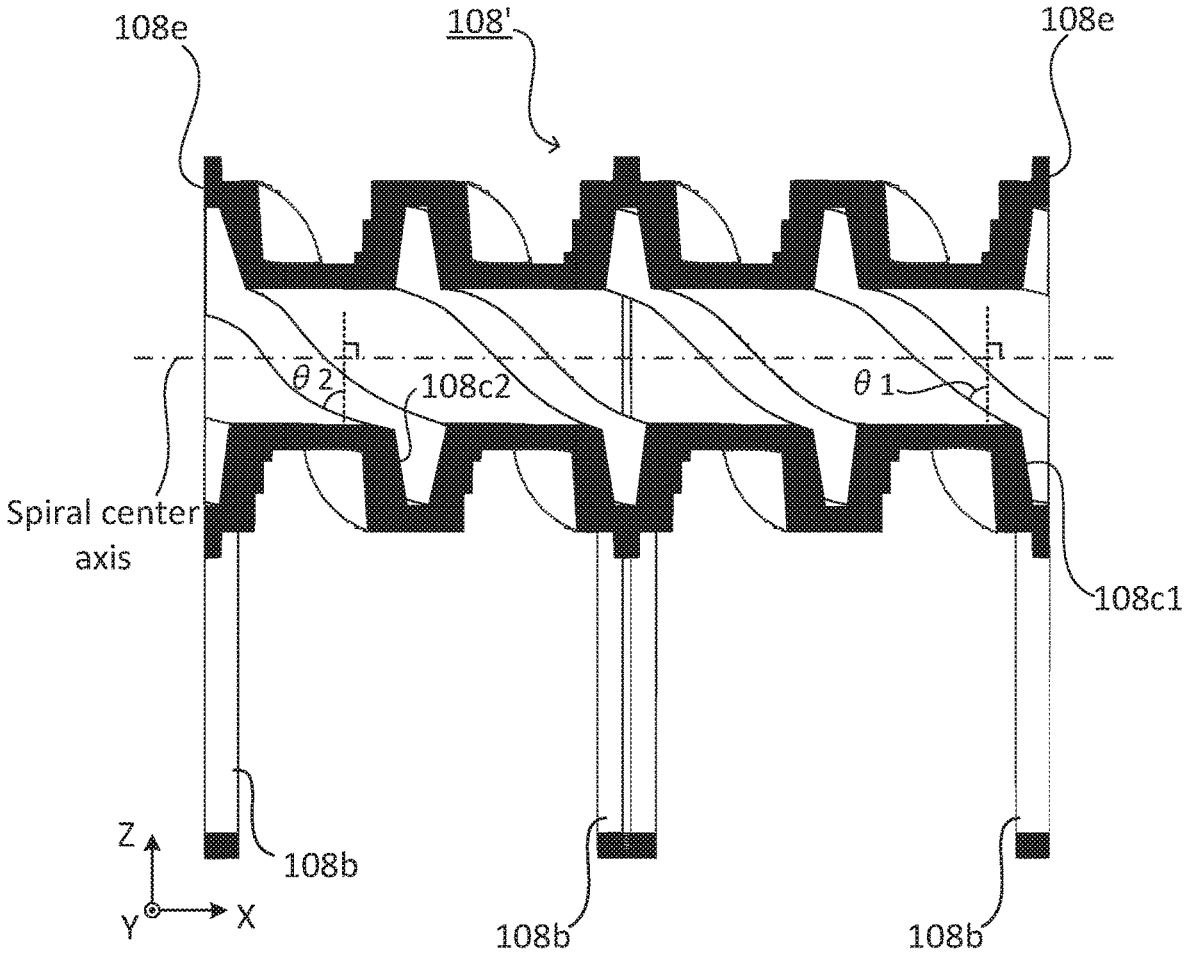
FIG. 12 is a partial sectional view in an X-Z plane depicting the cylindrical member 108' in the second embodiment.

FIG. 12 is a partial sectional view in an X-Z plane seen from a direction parallel to the Y axis showing a basic structure of a cylindrical member 108' in the second embodiment.

In this embodiment, an inclination angle θ1 to the Y-Z plane (the plane orthogonally crossing a spiral center axis) of an inclined guide surface 108*c*1 on which the protrusion 109*e* contacts when the tray 106 is at around a first height position is smaller than an inclination angle θ2 of an inclined guide surface 108*c*2 on which the protrusion 109*e* contacts when the tray 106 is at around a second height position lower than the first height position.

By this structure, the moving distance of the cylindrical member 108' in the rotational axis direction (amount of compression) per a unit rotation angle increases as the tray 106 moves downward. That is, a receiving force to elastically receive a weight of the tray 106 and sheets thereon when the tray 106 is at the second height position is larger than the receiving force when the tray 106 is at the first height position higher than the second height position.

According to the above embodiments, it is possible to efficiently absorb a shock because of the weight of the tray 106 and the sheets stacked thereon by both of the elastic pressing force by the compression spring 110 and a frictional resistance of the cam and slider mechanism H.

In the above embodiments, the sheet supplying apparatus of the present invention is externally attached to an image forming apparatus. However, it is also possible to apply the present invention to a paper feeding cassette which is insertable into a main body of the image forming apparatus.

In the above embodiments, the movement conversion mechanism 111 converts an up and down motion of the tray 106 in the Z axis direction to a rotational motion around the X axis direction with the pulley 111*p* and a wire rope 111. However, it is also possible to include a gear train into the movement conversion mechanism 111 to convert the up and down motion of the tray 106 to the rotational motion around the X axis direction.

In the above embodiments, the cylindrical member 108 has a spiral groove 108*c* formed on the inner surface 108*q*. However, the linearly movable member needs not necessarily be the cylindrical shape. That is, it is possible to form the spiral groove on an inner surface of a linearly movable member having other shape, as long as the groove can be stably guided by the protrusion 109*e*.

The present invention can be carried out in various forms without departing from main characteristics thereof. The embodiments are merely exemplars in every aspect and should not be limitedly interpreted. The scope of the present invention is indicated by the scope of claims. The text of the specification does not restrict the scope of the invention. All variations and various improvements, alterations, and modifications belonging to the scope of equivalents of the scope of claims are within the scope of the present invention.

What is claimed is:

1. An image forming apparatus, comprising:

a sheet supplying apparatus having a tray on which a plurality of sheets are stackable;

a guide mechanism configured to guide the tray in an up and down direction;

a movement conversion mechanism configured to convert an up and down motion of the tray to a rotational motion;

a rotary member supported to be rotatable around a rotational axis and comprising transmitted portion configured to receive the rotational motion converted from the up and down motion of the tray in cooperation with the movement conversion mechanism and a driven portion configured to receive a rotational driving force to lift the tray;

a cam and slider mechanism having a protrusion which integrally rotates with the rotary member and a cylindrical member through which the rotary member is inserted, the cylindrical member having a spiral groove formed on an inner surface thereof, and configured to convert the rotational motion of the rotary member around the rotational axis to a linear motion of the cylindrical member parallel to the rotational axis; and a compression spring configured to elastically press an end portion of the cylindrical member of the cam and slider mechanism parallel to the rotational axis to lift the tray.

2. The image forming apparatus according to claim 1, wherein the rotary member is a longitudinal member having the transmitted portion at one end thereof parallel to the rotational axis.

3. The image forming apparatus according to claim 1, wherein the compression spring is a coil spring, and the rotary member is inserted into the coil spring along a spiral center axis of the coil spring.

4. The image forming apparatus according to claim 1, wherein an inclination angle with respect to a plane orthogonally crossing a spiral center axis of an inclined guide surface that the protrusion contacts when the tray is at a first height position, less than the inclination angle when the tray is at a second height position lower than the first height position.

5. The image forming apparatus according to claim 1, wherein the rotary member has a plurality of protrusions provided at different angular positions along the rotational axis.

6. The image forming apparatus according to claim 1, wherein the cylindrical member has an anti-rotation bracket touching an inner surface of the sheet supplying apparatus so as to be slidable parallel to the rotational axis to regulate a rotation of the cylindrical member around the rotational axis.

7. The image forming apparatus according to claim 1, wherein the compression spring is a volute spring.

8. An image forming apparatus comprising:

a tray on which a plurality of sheets are stackable;

a guide mechanism configured to guide the tray in an up and down direction;

a movement conversion mechanism configured to convert an up and down motion of the tray to a rotational motion;

a rotary member supported to be rotatable around a rotational axis and comprising a transmitted portion configured to receive the rotational motion converted from the up and down motion of the tray in cooperation with the movement conversion mechanism and a driven portion configured to receive a rotational driving force to lift the tray;

a cam and slider mechanism having a protrusion which integrally rotates with the rotary member and a cylindrical member through which the rotary member is inserted, the cylindrical member having a spiral groove formed on an inner surface thereof, and configured to convert the rotational motion of the rotary member around the rotational axis to a linear motion of the cylindrical member parallel to the rotational axis;

a compression spring configured to elastically press an end portion of the cylindrical member of the cam and slider mechanism parallel to the rotational axis to lift the tray;

a sheet conveyer configured to convey a sheet stacked on the tray along a conveying path; and an image forming unit configured to form an image onto a surface of the sheet conveyed by the sheet conveyer.

9. The image forming apparatus according to claim 8, wherein the rotary member is a longitudinal member having the transmitted portion at one end thereof parallel to the rotational axis.

10. The image forming apparatus according to claim 8, wherein the compression spring is a coil spring, and the rotary member is insertable into the coil spring along a spiral center axis of the coil spring.

11. The image forming apparatus according to claim 8, wherein an inclination angle with respect to a plane orthogonally crossing a spiral center axis of an inclined guide surface that the protrusion contacts when the tray is at a first height position, less than the inclination angle when the tray is at a second height position lower than the first height position.

12. The image forming apparatus according to claim 8, wherein the rotary member has a plurality of protrusions provided at different angular positions-along the rotational axis.

13. The image forming apparatus according to claim 8, wherein the cylindrical member has an anti-rotation bracket touching an inner surface of the-image forming apparatus so as to be slidable parallel to the rotational axis to regulate a rotation of the cylindrical member around the rotational axis.

14. The image forming apparatus according to claim 8, wherein the compression spring is a volute spring.

15. An image forming apparatus, comprising:

a tray on which a plurality of sheets are stackable;

a shaft configured to rotate as the tray moves in an up and down direction;

a cam and slider mechanism having a protrusion which integrally rotates with the shaft and a sleeve through which the shaft is inserted, the sleeve having a spiral groove formed on an inner surface thereof, and configured to convert the rotational motion of the shaft to a linear motion of the sleeve;

a compression spring configured to elastically press an end portion of the sleeve to lift the tray;

a sheet conveyer configured to convey a sheet stacked on the tray along a conveying path; and an image forming unit configured to form an image onto a surface of the sheet conveyed by the sheet conveyer.

16. The image forming apparatus according to claim 15, wherein the shaft has a transmitted portion configured to receive a rotational motion converted from the up and down motion of the tray, at one end of the shaft.

17. The image forming apparatus according to claim 15, wherein the compression spring is a coil spring which is compressed as the sleeve moves linearly along the shaft, and the shaft is inserted into the coil spring along a spiral center axis of the coil spring.

18. The image forming apparatus according to claim 15, wherein an inclination angle with respect to a plane orthogonally crossing a spiral center axis of an inclined guide surface that the protrusion contacts when the tray is at a first height position, less than the inclination angle when the tray is at a second height position lower than the first height position.

19. The image forming apparatus according to claim 15, wherein the shaft has a plurality of protrusions provided at different angular positions along a rotational axis thereof.

20. The image forming apparatus according to claim 15, wherein the sleeve has an anti-rotation bracket touching an inner surface of the image forming apparatus so as to be slidable parallel to a rotational axis of the sleeve to regulate a rotation of the sleeve around the rotational axis.

* * * * *